US008104283B2

(12) United States Patent
Cheng et al.

(10) Patent No.: US 8,104,283 B2
(45) Date of Patent: Jan. 31, 2012

(54) STEAM TEMPERATURE CONTROL IN A BOILER SYSTEM USING REHEATER VARIABLES

(75) Inventors: Xu Cheng, Pittsburgh, PA (US); Charles H. Menten, Gibsonia, PA (US); Richard W. Kephart, Kittanning, PA (US)

(73) Assignee: Emerson Process Management Power & Water Solutions, Inc., Pittsburgh, PA (US)

( * ) Notice: Subject to any disclaimer, the term of this patent is extended or adjusted under 35 U.S.C. 154(b) by 998 days.

(21) Appl. No.: 11/759,805

(22) Filed: Jun. 7, 2007

(65) Prior Publication Data

US 2008/0302102 A1 Dec. 11, 2008

(51) Int. Cl.
*F01K 7/34* (2006.01)

(52) U.S. Cl. ..... 60/653; 60/667; 60/679

(58) Field of Classification Search ..... 60/677–679, 60/653, 660, 667
See application file for complete search history.

(56) References Cited

U.S. PATENT DOCUMENTS

| | | | | |
|---|---|---|---|---|
| 2,966,896 | A | 1/1961 | Vogler | |
| 3,035,556 | A * | 5/1962 | Brunner | 122/476 |
| 3,155,079 | A | 11/1964 | Clayton Jr. | |
| 3,202,138 | A | 8/1965 | Schroedter | |
| 3,291,106 | A | 12/1966 | Palchik et al. | |
| 4,593,528 | A * | 6/1986 | Bailey | 60/673 |
| 4,862,692 | A * | 9/1989 | Fukuda et al. | 60/670 |
| 4,870,823 | A * | 10/1989 | Silvestri, Jr. | 60/652 |
| 4,887,431 | A * | 12/1989 | Peet | 60/667 |
| 5,027,751 | A | 7/1991 | Archer et al. | |
| 7,109,446 | B1 | 9/2006 | Cheng et al. | |

FOREIGN PATENT DOCUMENTS

| | | |
|---|---|---|
| GB | 744797 A | 2/1956 |
| GB | 811843 A | 4/1959 |
| GB | 894533 | 4/1962 |
| GB | 1007738 | 10/1965 |
| GB | 1008792 | 11/1965 |

OTHER PUBLICATIONS

Search Report for Application No. GB0810372.3, dated Sep. 25, 2008.
European Search Report for 08157746.2 dated Aug. 5, 2010.
European Search Report for 09009827.8 dated Aug. 5, 2010.
Office action for CN 200810085965 mailed Jun. 24, 2011.
Fan, Q., "Study on Characteristics and Control of the Steam Temperature of Supercritical Boilers", Journal of Power Engineering, vol. 27, No. 1, pp. 34-37, Feb. 2002.

* cited by examiner

*Primary Examiner* — Hoang M Nguyen
(74) *Attorney, Agent, or Firm* — Marshall, Gerstein & Borun LLP

(57) ABSTRACT

A technique of controlling a boiler system such as that used in a power generation plant includes using manipulated variables associated with or control inputs to a reheater section of the boiler system to control the operation of the furnace, and in particular to control the fuel/air mixture provided to the furnace or the fuel to feedwater ratio used in the furnace or boiler. In the case of a once-through boiler type of boiler system, using the burner tilt position, damper position or reheater spray amount to control the fuel/air mixture or the fuel to feedwater flow ratio of the system provides better unit operational efficiency.

37 Claims, 4 Drawing Sheets

STEAM TEMPERATURE CONTROL IN A BOILER SYSTEM USING REHEATER VARIABLES

TECHNICAL FIELD

This patent relates generally to the control of boiler systems and in one particular instance to the control and optimization of once-through boiler type of steam generating systems having both a superheater section and a reheater section.

BACKGROUND

A variety of industrial as well as non-industrial applications use fuel burning boilers which typically operate to convert chemical energy into thermal energy by burning one of various types of fuels, such as coal, gas, oil, waste material, etc. An exemplary use of fuel burning boilers is in thermal power generators, wherein fuel burning boilers generate steam from water traveling through a number of pipes and tubes within the boiler, and the generated steam is then used to operate one or more steam turbines to generate electricity. The output of a thermal power generator is a function of the amount of heat generated in a boiler, wherein the amount of heat is directly determined by the amount of fuel consumed (e.g., burned) per hour, for example.

In many cases, power generating systems include a boiler which has a furnace that burns or otherwise uses fuel to generate heat which, in turn, is transferred to water flowing through pipes or tubes within various sections of the boiler. A typical steam generating system includes a boiler having a superheater section (having one or more sub-sections) in which steam is produced and is then provided to and used within a first, typically high pressure, steam turbine. To increase the efficiency of the system, the steam exiting this first steam turbine may then be reheated in a reheater section of the boiler, which may include one or more subsections, and the reheated steam is then provided to a second, typically lower pressure steam turbine. While the efficiency of a thermal-based power generator is heavily dependent upon the heat transfer efficiency of the particular furnace/boiler combination used to burn the fuel and transfer the heat to the water flowing within the various sections of the boiler, this efficiency is also dependent on the control technique used to control the temperature of the steam in the various sections of the boiler, such as in the superheater section of the boiler and in the reheater section of the boiler.

However, as will be understood, the steam turbines of a power plant are typically run at different operating levels at different times to produce different amounts of electricity based on energy or load demands. However, for most power plants using steam boilers, the desired steam temperature setpoints at final superheater and reheater outlets of the boilers are kept constant, and it is necessary to maintain steam temperature close to the setpoints (e.g., within a narrow range) at all load levels. In particular, in the operation of utility (e.g., power generation) boilers, control of steam temperature is critical as it is important that the temperature of steam exiting from a boiler and entering a steam turbine is at an optimally desired temperature. If the steam temperature is too high, the steam may cause damage to the blades of the steam turbine for various metallurgical reasons. On the other hand, if the steam temperature is too low, the steam may contain water particles, which in turn may cause damage to components of the steam turbine over prolonged operation of the steam turbine as well as decrease efficiency of the operation of the turbine. Moreover, variations in steam temperature also causes metal material fatigue, which is a leading cause of tube leaks.

Typically, each section (i.e., the superheater section and the reheater section) of the boiler contains cascaded heat exchanger sections wherein the steam exiting from one heat exchanger section enters the following heat exchanger section with the temperature of the steam increasing at each heat exchanger section until, ideally, the steam is output to the turbine at the desired steam temperature. In such an arrangement, steam temperature is controlled primarily by controlling the temperature of the water at the output of the first stage of the boiler which is primarily achieved by changing the fuel/air mixture provided to the furnace or by changing the ratio of firing rate to input feedwater provided to the furnace/boiler combination. In once-through boiler systems, in which no drum is used, the firing rate to feedwater ratio input to the system may be used primarily to regulate the steam temperature at the input of the turbines.

While changing the fuel/air ratio and the firing rate to feedwater ratio provided to the furnace/boiler combination operates well to achieve desired control of the steam temperature over time, it is difficult to control short term fluctuations in steam temperature at the various sections of the boiler using only fuel/air mixture control and firing rate to feedwater ratio control. Instead, to perform short term (and secondary) control of steam temperature, saturated water is sprayed into the steam at a point before the final heat exchanger section located immediately upstream of the turbine. This secondary steam temperature control operation typically occurs before the final superheater section of the boiler and/or before the final reheater section of the boiler. To effect this operation, temperature sensors are provided along the steam flow path and between the heat exchanger sections to measure the steam temperature at critical points along the flow path, and the measured temperatures are used to regulate the amount of saturated water sprayed into the steam for steam temperature control purposes.

Of course, both of these types of control can be generally performed using measurements of the initial output temperature of the boiler (called the water wall temperature), as well as an indication of the desired spray. In traditional boiler operations, a distributed control system (DCS) is used to provide control of both the fuel/air mixture provided to the furnace as well as control of the amount of spraying performed upstream of the turbines. As will be understood, however, the spray control technique can only operate to reduce the temperature of the steam over that developed within the various sections of the boiler, and thus the steam temperature at the outputs of the various sections of the boiler must be assured to be higher than otherwise might be necessary to assure that the steam temperature at the input of the turbines is high enough. Thus, use of the spray technique (which always operates to reduce the steam temperature at the spray nozzle) reduces the efficiency of the overall power generation system and thus should ideally be minimized. Moreover, depending on the power requirements of the electricity generation or other power generation system and the temperature of the spray feed, a lot of water may have to be sprayed into the steam to produce a significant reduction in steam temperature, meaning that it may be difficult to effectively use the spray technique to provide the necessary control in all situations.

None-the-less, in many circumstances, it is necessary to rely heavily on the spray technique to control the steam temperature as precisely as needed to satisfy the turbine temperature constraints described above. For example, once-through boiler systems, which provide a continuous flow of water (steam) through a set of pipes within the boiler and do not use a drum to, in effect, average out the temperature of the steam or water exiting the first boiler section, may experience greater fluctuations in steam temperature and thus typically require heavier use of the spray sections to control the steam temperature at the inputs to the turbines. In these systems, the tiring rate to feedwater ratio control is typically used, along with superheater spray flow, to regulate the furnace/boiler system. However, the desired superheater spray flow setpoint used to regulate superheater spray flow is quite arbitrary because its impact on heat rate (efficiency) is minimal, depending upon where the spray flow is drawn. Thus, while the spray flow technique is very effective in controlling steam temperature, its usage decreases the boiler efficiency and, as a result, it is harder to obtain optimum efficiency in the these types of systems.

SUMMARY

A technique of controlling a steam generating system includes using manipulated variables or control inputs of the reheater section of the boiler system to control the operation of the furnace/boiler portion of the system, such as to control the firing rate to feedwater input ratio used in the furnace/boiler combination. In particular, it is believed that, for example, in the case of a once-through boiler type of steam generating system, using signals indicative of the burner tilt position(s), damper position(s) or reheater spray amount associated with the reheater section of the system to control the fuel to feedwater flow ratio into the furnace/boiler section of the system provides better efficiency over current systems.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention as describing every possible embodiment would be impractical, if not impossible. Numerous alternative embodiments could be implemented, using either current technology or technology developed after the filing date of this patent, which would still fall within the scope of the claims defining the invention.

Figure 1:
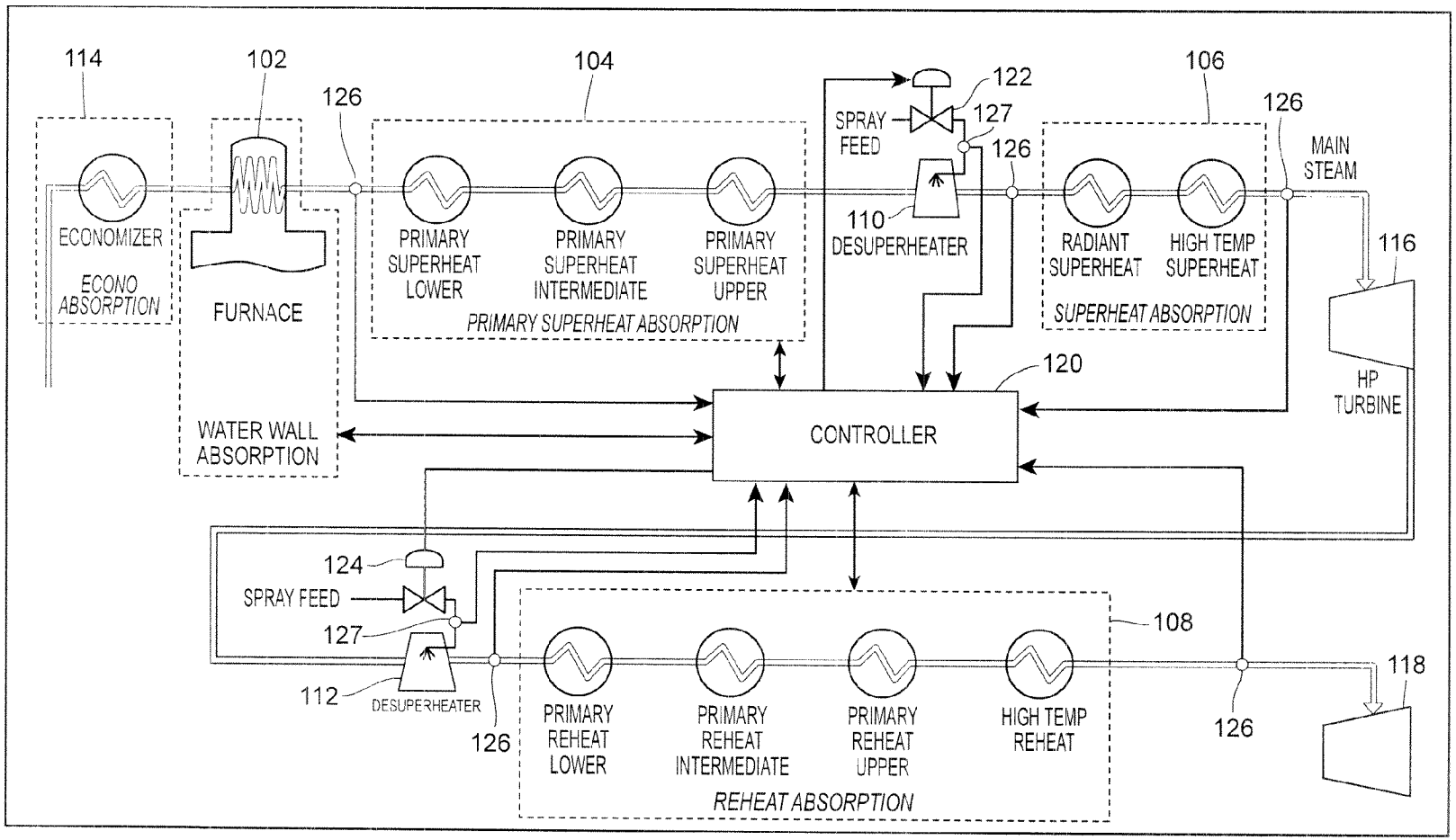
FIG. 1 illustrates a block diagram of a typical boiler steam cycle for a typical set of steam powered turbines, the boiler steam cycle having a superheater section and a reheater section.

FIG. 1 illustrates a block diagram of a once-through boiler steam cycle for a typical boiler 100 that may be used, for example, in a thermal power plant. The boiler 100 may include various sections through which steam or water flows in various forms such as superheated steam, reheated steam, etc. While the boiler 100 illustrated in FIG. 1 has various boiler sections situated horizontally, in an actual implementation, one or more of these sections may be positioned vertically with respect to one another, especially because flue gases heating the steam in various different boiler sections, such as a water wall absorption section, rise vertically (or, spirally vertical).

In any event, as illustrated in FIG. 1, the boiler 1001 includes a furnace and a primary water wall absorption section 102, a primary superheater absorption section 104, a superheater absorption section 106 and a reheater section 108. Additionally, the boiler 100 may include one or more desuperheaters or sprayer sections 110 and 112 and an economizer section 114. During operation, the main steam generated by the boiler 100 and output by the superheater section 106 is used to drive a high pressure (HP) turbine 116 and the hot reheated steam coming from the reheater section 108 is used to drive an intermediate pressure (IP) turbine 118. Typically, the boiler 100 may also be used to drive a low pressure (LP) turbine, which is not shown in FIG. 1.

The water wall absorption section 102, which is primarily responsible for generating steam, includes a number of pipes through which water or steam from the economizer section 114 is heated in the furnace. Of course, feedwater coming into the water wall absorption section 102 may be pumped through the economizer section 114 and this water absorbs a large amount of heat when in the water wall absorption section 102. The steam or water provided at output of the water wall absorption section 102 is fed to the primary superheater absorption section 104, and then to the superheater absorption section 106, which together raise the steam temperature to very high levels. The main steam output from the superheater absorption section 106 drives the high pressure turbine 116 to generate electricity.

Once the main steam drives the high pressure turbine 116, the steam is routed to the reheater absorption section 108, and the hot reheated steam output from the reheater absorption section 108 is used to drive the intermediate pressure turbine 118. The spray sections 110 and 112 may be used to control the final steam temperature at the inputs of the turbines 116 and 118 to be at desired setpoints. Finally, the steam from the intermediate pressure turbine 118 may be fed through a low pressure turbine system (not shown here), to a steam condenser (not shown here), where the steam is condensed to a liquid form, and the cycle begins again with various boiler feed pumps pumping the feedwater through a cascade of feedwater heater trains and then an economizer for the next cycle. The economizer section 114 is located in the flow of hot exhaust gases exiting from the boiler and uses the hot gases to transfer additional heat to the feedwater before the feedwater enters the water wall absorption section 102.

As illustrated in FIG. 1, a controller 120 is communicatively coupled to the furnace within the water wall section 102 and to valves 122 and 124 which control the amount of water provided to sprayers in the spray sections 110 and 112. The controller 120 is also coupled to various sensors, including temperature sensors 126 located at the outputs of the water wall section 102, the desuperheater section 110, the second superheater section 106, the desuperheater section 112 and the reheater section 108 as well as flow sensors 127 at the outputs of the valves 122 and 124. The controller 120 also receives other inputs including the firing rate, a signal (typically referred to as a feedforward signal) which is indicative of and a derivative of the load, as well as signals indicative of settings or features of the boiler including, for example, damper settings, burner tilt positions, etc. The controller 120 may generate and send other control signals to the various boiler and furnace sections of the system and may receive other measurements, such as valve positions, measured spray flows, other temperature measurements, etc. While not specifically illustrated as such in FIG. 1, the controller 120 could include separate sections, routines and/or control devices for controlling the superheater and the reheater sections of the boiler system.

Figure 2:
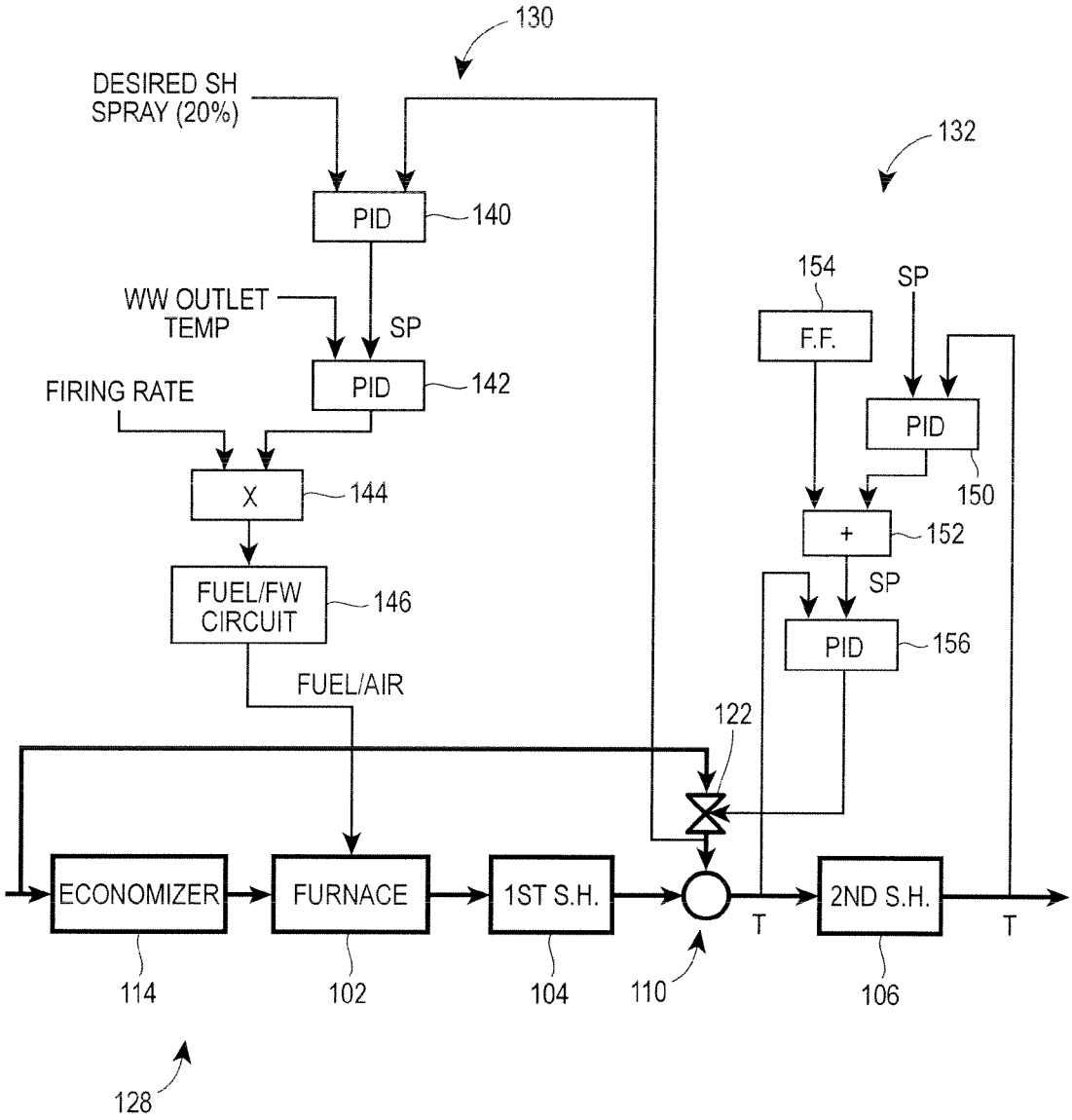
FIG. 2 PRIOR ART
FIG. 2 illustrates a schematic diagram of a prior art manner of controlling a superheater section of a boiler steam cycle for a steam powered turbine, such as that of FIG. 1.

FIG. 2 is a schematic diagram 128 showing the various sections of the boiler system 100 of FIG. 1 and illustrating a typical manner in which control is currently performed in once-through boilers in the prior art. In particular, the diagram 128 illustrates the economizer 114, the primary furnace or water wall section 102, the first superheater section 104, the second superheater section 106 and the spray section 110 of FIG. 2. In this case, the spray water provided to the superheater spray section 110 is tapped from the feed line into the economizer 114. FIG. 2 also illustrates two control loops 130 and 132 which may be implemented by the controller 120 of FIG. 1 or by other DCS controllers to control the fuel and feedwater operation of the furnace 102.

In particular, the control loop 130 includes a first control block 140 (illustrated in the form of a proportional-derivative-integral (PID) control block) which uses, as a primary input, a setpoint in the form of desired superheater spray. This desired superheater spray setpoint is typically set by a user or an operator. The control block 140 compares the superheater spray setpoint to a measure of the actual superheater spray amount (e.g., superheater spray flow) currently being used to produce a desired water wall outlet temperature setpoint. The water wall output temperature setpoint is indicative of the desired water wall outlet temperature needed to control the temperature at the output of the second superheater 106 to be at the desired turbine input temperature, using the amount of spray flow specified by the desired superheater spray setpoint. This water wall outlet temperature setpoint is provided to a second control block 142 (also illustrated as a PID control block), which compares the water wall outlet temperature setpoint to a signal indicative of the measured water wall steam temperature and operates to produce a feed control signal. The feed control signal is then scaled in a multiplier block 144, for example, based on the firing rate (which is indicative of or based on the power demand). The output of the multiplier block 144 is provided as a control input to a fuel/feedwater circuit 146, which operates to control the firing rate to feedwater ratio of the furnace/boiler combination or to control the fuel to air mixture provided to the primary furnace section 102.

The operation of the superheater spray section 110 is controlled by the control loop 132. The control loop 132 includes a control block 150 (illustrated in the form of a PID control block) which compares a temperature setpoint for the temperature of the steam at the input to the turbine 116 (typically fixed or tightly set based on operational characteristics of the turbine 116) to a measurement of the actual temperature of the steam at the input of the turbine 116 to produce an output control signal based on the difference between the two. The output of the control block 150 is provided to a summer block 152 which adds the control signal from the control block 150 to a feedforward signal which is developed by a block 154 as, for example, a derivative of the load signal. The output of the summer block 152 is then provided as a setpoint to a further control block 156 (again illustrated as a PID control block), which setpoint indicates the desired temperature at the input to the second superheater section 106. The control block 156 compares the setpoint from the block 152 to a measurement of the steam temperature at the output of the superheater spray section 110 and, based on the difference between the two, produces a control signal to control the valve 122 which controls the amount of the spray provided in the superheater spray section 110.

Thus, as will be seen from the control loops 130 and 132 of FIG. 2, the operation of the furnace 102 is directly controlled as a function of the desired superheater spray. In particular, the control loop 132 operates to keep the temperature of the steam at the input of the turbine 116 at a setpoint by controlling the operation of the superheater spray section 100, and the control loop 130 controls the operation of the fuel provided to and burned within the furnace 102 to keep the superheater spray at a predetermined setpoint (to thereby attempt to keep the superheater spray operation or spray amount at an "optimum" level).

Figure 3:
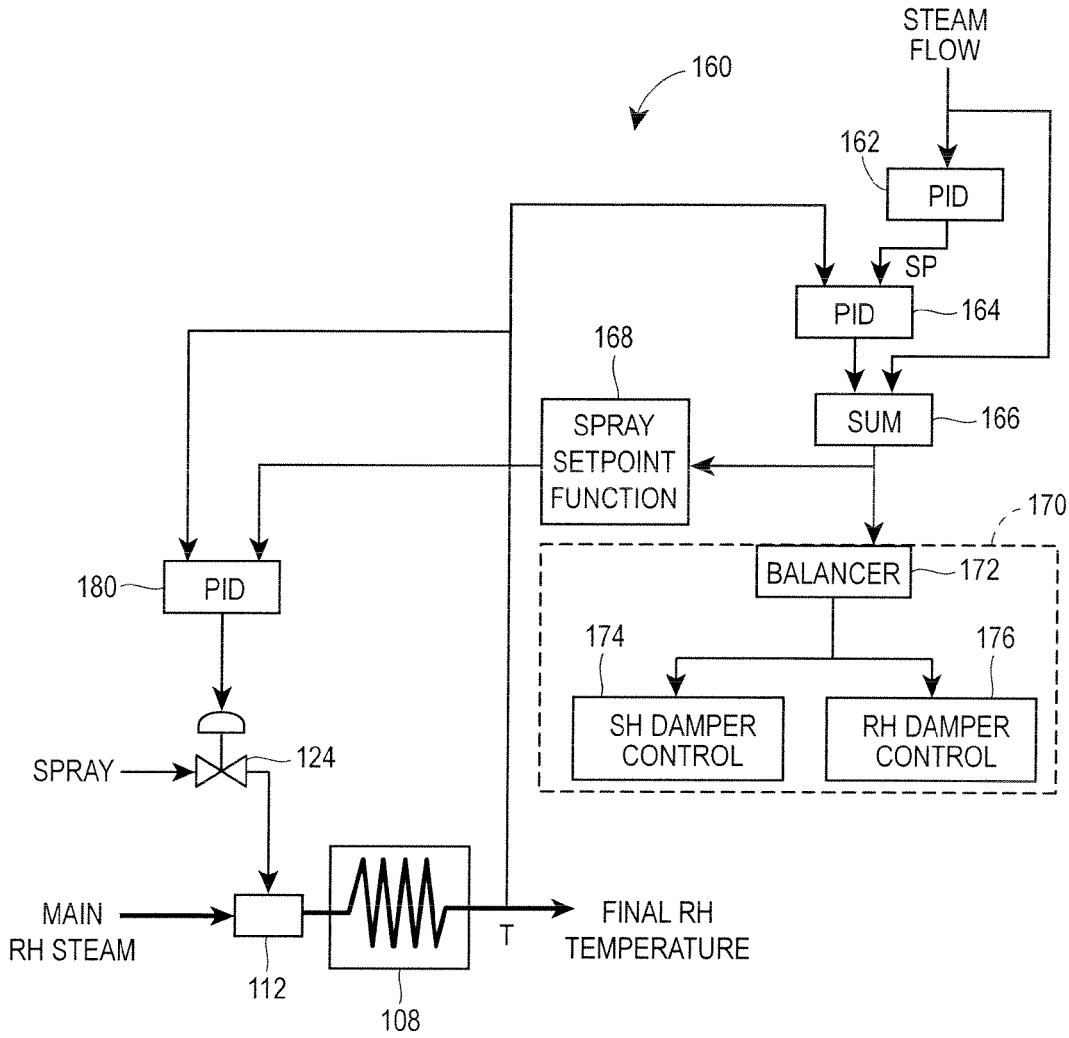
FIG. 3 PRIOR ART
FIG. 3 illustrates a schematic diagram of a prior art manner of controlling a reheater section of a boiler steam cycle for a steam powered turbine system, such as that of FIG. 1.

FIG. 3 illustrates a the typical (prior art) control loop 160 used in a reheater section 108 of a steam turbine power generation system, which may be implemented by, for example, the controller 120 of FIG. 1. Here, a control block 162 produces a temperature setpoint for the temperature of the steam being input to the turbine 118 as a function of the steam flow (which is typically determined by load demands). A control block 164 (illustrated as a PID control block) compares this temperature setpoint to a measurement of the actual steam temperature at the output of the reheater section 108 to produce a control signal as a result of the difference between these two temperatures. A block 166 then sums this control signal with a measure of the steam flow and the output of the block 166 is provided to a spray setpoint unit or block 168 as well as to a balancer unit 170.

The balancer unit 170 includes a balancer 172 which provides control signals to a superheater damper control unit 174 as well as to a reheater damper control unit 176 which operate to control the flue gas dampers in the various superheater and the reheater sections of the boiler. As will be understood, the flue gas damper control units 174 and 176 alter or change the damper settings to control the amount of flue gas from the furnace which is diverted to each of the superheater and reheater sections of the boilers. Thus, the control units 174 and 176 thereby control or balance the amount of energy provided to each of the superheater and reheater sections of the boiler. As a result, the balancer unit 170 is the primary control provided on the reheater section 108 to control the amount of energy or heat generated within the furnace 102 that is used in the operation of the reheater section 108 of the boiler system of FIG. 1. Of course, the operation of the dampers provided by the balancer unit 170 controls the ratio or relative amounts of energy or heat provided to the reheater section 108 and the superheater sections 104 and 106, as diverting more flue gas to one section typically reduces the amount of flue gas provided to the other section. Still further, while the balancer unit 170 is illustrated in FIG. 3 as performing damper control, the balancer 170 can also provide control using furnace burner tilt position or in some cases, both.

Because of temporary or short term fluctuations in the steam temperature, and the tact that the operation of the balancer unit 170 is tied in with operation of the superheater sections 104 and 106 as well as the reheater section 108, the balancer unit 170 may not be able to provide complete control of the steam temperature at the output of the reheater section 108, to assure that the desired steam temperature at this location is attained. As a result, secondary control of the steam temperature at the input of the turbine 118 is provided by the operation of the reheater spray section 112.

In particular, control of the reheater spray section 112 is provided by the operation of the spray setpoint unit 168 and a control block 180. Here, the spray setpoint unit 168 determines a reheater spray setpoint based on a number of factors, taking into account the operation of the balancer unit 170, in well known manners. Typically, however, the spray setpoint unit 168 is configured to operate the reheater spray section 112 only when the operation of the balancer unit 170 cannot provide enough or adequate control of the steam temperature at the input of the turbine 118. In any event, the reheater spray setpoint is provided as a setpoint to the control block 180 (again illustrated as a PID control block) which compares this setpoint with a measurement of the actual steam temperature at the output of the reheater section 108 and produces a control signal based on the difference between these two signals, and the control signal is used to control the reheater spray valve 124. As is known, the reheater spray valve 124 then operates to provide a controlled amount of reheater spray to perform further or additional control of the steam temperature at output of the reheater 108.

As will be understood from the descriptions of the control loops of FIGS. 2 and 3, the steam temperature is controlled in the reheater section 108 primarily by manipulation of the damper or burner tilt positions and secondarily by operation of the reheater spray section 112. However, control of the damper or burner tilt positions effects the amount of energy or heat provided to the superheater sections 104 and 106. Moreover, the control of the superheater sections 104 and 106 is primarily based on the amount of fuel provided to the furnace (e.g., the fuel to feedwater ratio) which is, in turn, controlled or based on a desired superheater spray setpoint. However, determination of the desired superheater spray setpoint is quite arbitrary, as the impact of this setpoint on the heat rate (efficiency) is minimal and typically is unknown.

Figure 4:
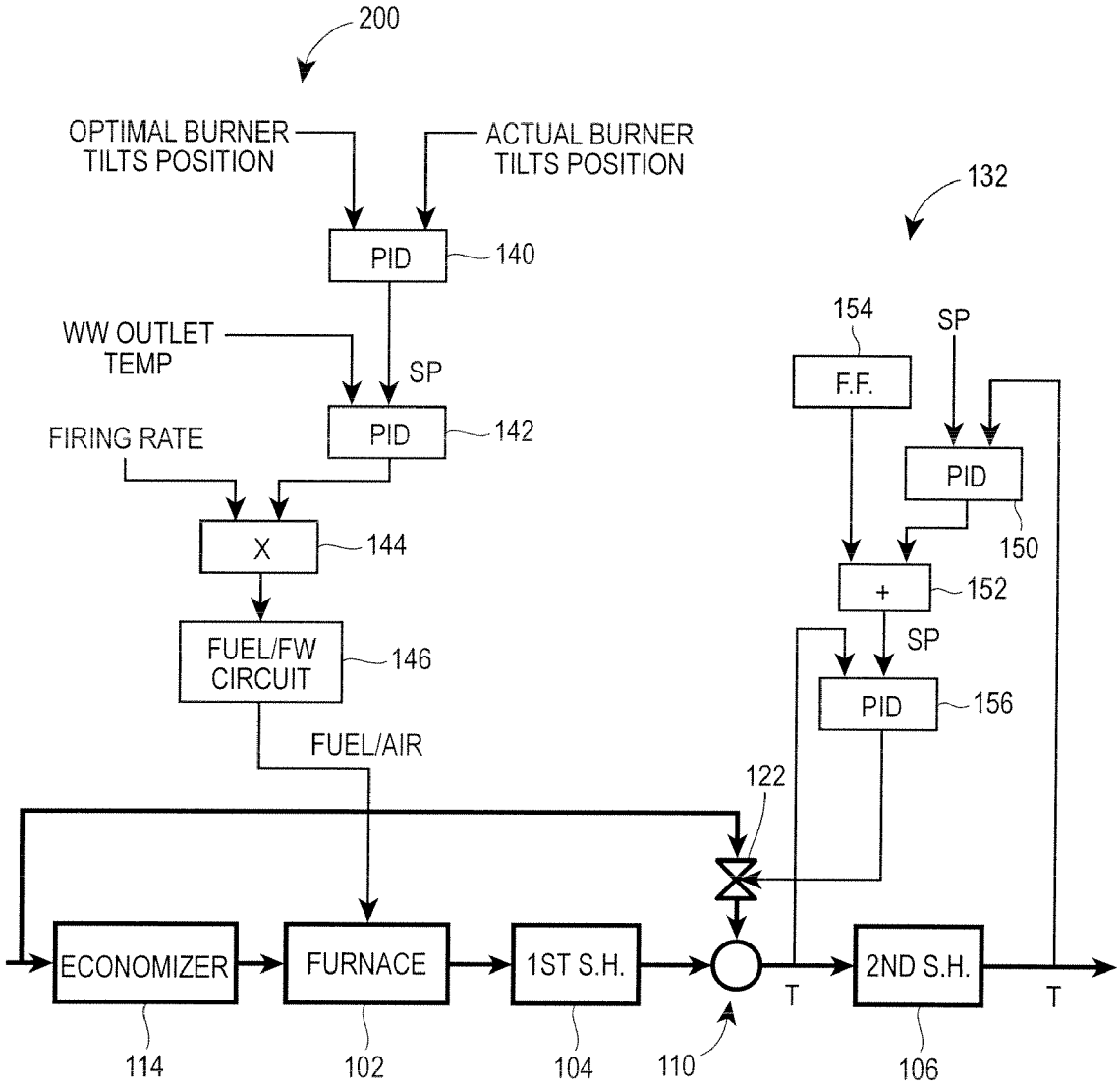
FIG. 4 illustrates a schematic diagram of a manner of controlling the boiler steam cycle of the steam powered turbines of FIG. 1 in a manner which helps to optimize efficiency of the system.

A better manner of controlling the boiler system 100 of FIG. 1 is illustrated in FIG. 4 in which similar blocks as those shown in FIG. 2 are illustrated with the same reference numbers. As will be noted, the control scheme illustrated in FIG. 4 used to control the operation of the furnace 102, shown as control loop 200, is very similar to the control loop 130 of FIG. 2, but instead uses, as the primary input to the control block 140, a factor or signal used to control or associated with the reheater section 108 of the boiler system 100 instead of a desired superheater spray setpoint. Thus, as illustrated in the control loop 200 of FIG. 4, a desired or optimal burner tilt position is input to the control block 104. Of course, while the burner tilt position is illustrated in FIG. 4 as the input to the control block 140, other signals or factors used in the control of or associated with the reheater section 108 could be used instead or in combination, including for example, signals related to damper positions of the dampers within the boiler system 100, signals related to the reheater steam spray, etc. Thus, for example, in implementing this new type of control, the controller 120 of FIG. 1 may receive signals or use signals related to burner tilt position(s) of one or more burners in the boiler (especially the burners that effect the operation of or the heat provided to the reheater section 108) or related to the damper position(s) of one or more dampers used in the boiler to direct heat flow through the reheater section 108 of the boiler or signals related to the control of the reheater spray section 112 including, for example, the output of the spray setpoint unit 168, the output of the PID control block 180, a measure of the position of the valve 124, a measure of the actual amount of spray (e.g., flow or temperature reduction) being provided by the reheater spray section 112, to produce the water wall outlet setpoint signal for the control block 142.

Of course, while certain reheater control related signals are described herein as being input to the control loop 200, other reheater control related signals or factors could be used as well or in other circumstances. Likewise, while the diagram of FIG. 4 illustrates a particular cascaded control loop or routine 200 to implement control of the furnace 102, other desired types, kinds or configurations of control loops may be used instead of or in addition to that shown in FIG. 4, as long as these control loops use one or more reheater control or manipulated variable signals to control the operation of the furnace or boiler. Thus, for example, the control loop 200 could be configured in other manners, could use other types of control blocks or routines (such as other than PID control blocks), and could use other signals in any desired manner to combine with the reheater control related signal or the reheater manipulated variable signals to control the operation of the furnace 102. For example, the control loop 200 could include a multi-input/single-output or a multiple-input/multiple-output control routine (such as a neural network routine, a model predictive control routine, an expert system based control routine, etc.) which accepts a number of inputs including one or more inputs related to or indicative of reheater section control or manipulated variables as well as potentially other inputs, to develop one or more output control signals to control the operation of the boiler/furnace to thereby provide steam temperature control. Additionally, while the control loop 200 of FIG. 4 is illustrated as producing a control signal for controlling the fuel/air mixture of the fuel provided to the furnace 102, the control loop 200 could produce other types or kinds of control signals to control the operation of the furnace such as the fuel to feedwater ratio used to provide fuel and feedwater to the furnace/boiler combination, the amount or quantity or type of fuel used in or provided to the furnace, etc.

In any event, in the example illustrated in FIG. 4, the control block 140 compares the actual burner tilt positions with an optimal burner tilt position, which may come from off-line unit characterization (especially for boiler systems manufactured by Combustion Engineering) or a separate on-line optimization program or other source. Of course, in a different boiler design configuration, if flue gas by-pass damper(s) are used for primary reheater steam temperature control, then the signals indicative of the desired (or optimal) and actual burner tilt positions in the control loop 200 may be replaced or supplemented with signals indicative of or related to the desired (or optimal) and actual damper positions. Still further, instead of or in addition to the burner tilt positions and damper positions, the control block 140 may use a desired or optimal reheater spray flow setpoint as well as measurements of reheater spray flow to perform control. In this case, the optimal setpoint is generally the flow rate of reheater spray that is kept at a minimum while still being able to regulate steam temperature. Still further the control block 140 may use some reheater variable (manipulated variable) even if that variable itself is not used to directly control the reheater steam temperature.

It is believed that the use of a reheater manipulated and control variable, such as burner tilt positions, damper positions or reheater spray, to control the operation of the boiler or furnace 102 provides more direct impact on boiler efficiency and heat rate than, for example, superheater spray. In particular, it is believed that this approach has more direct and immediate control on boiler efficiency and heat rate than superheater spray variables, in addition to controlling the superheat and reheat steam temperatures as usual. For example, burner tilt positions directly affect the fire-ball position and flame temperature in the furnace, which directly affects combustion efficiency. Of course, the optimal setpoint for burner tilt position or damper position, can be determined by a separate procedure. If reheat steam temperature is controlled by reheater spray, the amount of spray flow also has a huge impact on heat rate. In fact, compared with superheater spray flow, the impact of reheater spray flow on heat rate is believed to be approximately 10 times higher, thus making reheater spray flow a better control variable for boiler or furnace control. More particularly, the primary difference between the cost of reheater and superheater sprays relates to the difference in additional energy that needs to be added in the boiler for these sprays. For example, if superheater sprays are used, and they come from the boiler feed pump, the enthalpy entering the boiler is about 320 Btu/lb. If no sprays were used, the same flow would come from final feedwater and enter the boiler at 480 Btu/lb and so an additional 160 btu/lb needs to be added from fuel in the boiler for superheater sprays. For reheater sprays, assuming that they also come from the boiler feed pump at 320 Btu/lb, cold reheat enthalpy is typically 1300 Btu/lb, and hot reheat enthalpy is typically 1520 Btu/lb. So here it is necessary to add about 1200 Btu/lb additional energy, making the use of reheater sprays (or other reheater variables) as a primary boiler control variable more effective in increasing boiler efficiency.

In any event, as will be seen from FIG. 4, the rest of the control loop 200 is the same as or is similar to the control loop 130 of FIG. 2 and operates in essentially the same manner, except that the primary setpoint and control input into the loop 200 is derived from a reheater control or manipulated variable, instead of the superheater spray. However, as noted above, the details and implementation of the control loop 200 may be changed or be varied to control the operation of the furnace/boiler and the specific details of the control loop 200 shown in FIG. 4 are not limiting of the invention, which is to control the operation of the furnace/boiler based on a reheater section manipulated or control variable, such as burner tilt position, damper position, reheater spray, etc. Likewise, the control of the superheater spray section 110 may be performed as illustrated in FIG. 2 or 4 or may be changed in any desired manner in FIG. 4. In a similar manner, and the control of the reheater spray section 112 may be performed in the system of FIG. 4 using the same control scheme shown in FIG. 3 or in any other desired manner. Also, the use of a reheater section manipulated or control variable in the control loop 200 of FIG. 4 is not limited to a control variable or a manipulated variable used to actually control the reheater section in a particular instance. Thus, it may be possible to use a reheater manipulated variable that is not actually used to control the reheater section 108 as an input to the control loop 200 that controls the furnace/boiler operation of the turbine system.

Still further, the control scheme described herein is applicable to steam generating systems that use other types of configurations for superheater and reheater sections than illustrated or described herein. Thus, while FIGS. 1-4 illustrate two superheater sections and one reheater section, the control scheme described herein may be used with boiler systems having more or less superheater sections and reheater sections, and which use any other type of configuration within each of the superheater and reheater sections.

Although the forgoing text sets forth a detailed description of numerous different embodiments of the invention, it should be understood that the scope of the invention is defined by the words of the claims set forth at the end of this patent. The detailed description is to be construed as exemplary only and does not describe every possible embodiment of the invention because describing every possible embodiment would be impractical, if not impossible. Numerous alternative embodiments could be implemented, using either current technology or technology developed after the filing date of this patent, which would still fall within the scope of the claims defining the invention.

Thus, many modifications and variations may be made in the techniques and structures described and illustrated herein without departing from the spirit and scope of the present invention. Accordingly, it should be understood that the methods and apparatus described herein are illustrative only and are not limiting upon the scope of the invention.

What is claimed is:

1. A method of controlling a steam generating boiler system having a furnace, a superheater section and a reheater section, comprising:

obtaining, at a controller, a first signal, the first signal being indicative of a desired value of:
- a reheater control variable, or
- a reheater manipulated variable, and the first signal being not indicative of a superheater spray setpoint;

obtaining, at the controller, a second signal indicative of an actual value of:
- the reheater control variable, or
- the reheater manipulated variable;

using the first signal in conjunction with the second signal to generate, by the controller, a third signal; and using the third signal in conjunction with a signal indicative of a firing rate to generate, by the controller, a fourth signal to control:
- a fuel feedwater ratio of the furnace and a boiler of the steam generating boiler system,
- a fuel/air mixture provided to the furnace, or
- an amount, a quanity or a type of fuel,
- to thereby control a steam temperature generated by the superheater section.

2. The method of controlling a steam generating boiler system of claim 1, wherein obtaining the first signal includes obtaining a signal indicative of a furnace burner tilt position.

3. The method of controlling a steam generating boiler system of claim 1, wherein obtaining the first signal includes obtaining a signal indicative of a damper position.

4. The method of controlling a steam generating boiler system of claim 3, wherein the signal indicative of a damper position comprises a signal indicative of a damper position in the reheater section of the boiler.

5. The method of controlling a steam generating boiler system of claim 1, wherein using the first signal in conjuction with the second signal includes comparing the first signal with the second signal and using a difference between the first signal and the second signal to generate the third signal.

6. The method of controlling a steam generating boiler system of claim 1, wherein using the fourth signal to control the fuel/air mixture provided to the furnace includes varying fuel/air mixture provided to the furnace to operate the furnace based on changes in the fourth signal.

7. The method of controlling a steam generating boiler system of claim 1, wherein using the fourth signal to control the fuel to feedwater ratio of the furnace and the boiler includes varying the fuel to feedwater ratio used in the furnace and the boiler based on changes in the fourth signal.

8. The method of controlling a steam generating boiler system of claim 1, wherein obtaining the first signal includes obtaining a signal indicative of a once-through boiler reheater manipulated variable used to control steam temperature in a once-through reheater section.

9. The method of controlling a steam generating boiler system of claim 1, wherein:

using the first signal in conjunction with the second signal to generate the third signal includes using a first proportional-integral-derivative control routine to generate the third signal based on the first signal and the second signal; and using the third signal in conjunction with the signal indicative of the firing rate to generate the fourth signal includes using a second proportional-integral-derivative control routine to generate the fourth signal based on the third signal and the signal indicative of the firing rate.

10. The method of controlling a steam generating boiler system of claim 1, wherein:

using the first signal in conjunction with the second signal to generate the third signal includes using a first multiple-input/multiple-output control routine to generate the third signal based on the first signal and the second signal; and using the third signal in conjunction with the signal indicative of the firing rate to generate the fourth signal includes using a second multiple-input/multiple-output control routine to generate the fourth signal based on the third signal and the signal indicative of the firing rate.

11. The method of controlling a steam generating boiler system of claim 1, wherein:

using the first signal in conjunction with the second signal to generate the third signal includes using a first multiple-input/single-output control routine to generate the third signal based on the first signal and the second signal; and using the third signal in conjunction with the signal indicative of the firing rate to generate the fourth signal includes using a second multiple-input/single-output control routine to generate the fourth signal based on the third signal and the signal indicative of the firing rate.

12. A controller unit for use in a steam generating boiler system having a boiler with a furnace, a superheater section and a reheater section, the controller unit comprising:

a first input to receive a setpoint corresponding to at least one of a reheater steam temperature control variable or a reheater steam temperature manipulated variable, wherein the setpoint does not correspond to a superheater spray;

a second input to receive a signal indicative of an actual value of the at least one of the reheater steam temperature control variable or the reheater steam temperature manipulated variable; a control routine that uses the signal indicative of the actual value of the at least one of the reheater steam temperature control variable or the reheater steam temperature manipulated variable and the setpoint associated with the at least one of the reheater steam temperature control variable or the reheater steam temperature manipulated variable to develop a first signal, and that uses the first signal indicative of a firing rate to develop a control signal; and an output to provide the control signal to the furnace to control:

a fuel to feedwater ratio of the furnace and a boiler of the steam generating boiler system, a fuel/air mixture provided to the furnace, or an amount, a quantity or a type of fuel, thereby controlling a steam temperature generated by the superheater section.

13. The controller unit of claim 12, wherein the at least one of the reheater steam temperature control variable or the reheater steam temperature manipulated variable is indicative of a burner tilt position in the furnace.

14. The controller unit of claim 12, wherein the at least one of the reheater steam temperature control variable or the reheater steam temperature manipulated variable is indicative of a damper position of a damper in the boiler.

15. The controller unit of claim 12 wherein the control routine compares the actual value of the at least one of the reheater steam temperature control variable or the reheater steam temperature manipulated variable with the setpoint and uses a difference between the actual value of the at least one of the reheater steam temperature control variable or the reheater steam temperature manipulated variable and the setpoint to develop the first signal.

16. The controller unit of claim 12, wherein the control signal developed at the output operates to vary the fuel/air mixture provided to the furnace to operate the furnace based on changes in the at least one of the reheater steam temperature control variable or the reheater steam temperature manipulated variable.

17. The controller unit of claim 12, wherein the control signal developed at the output operates to vary the fuel to feedwater ratio used in the furnace and the boiler to operate the furnace based on changes in the at least one of the reheater steam temperature control variable or the reheater steam temperature manipulated variable.

18. The controller unit of claim 12, wherein the control routine implements a proportional-integral-derivative control routine to generate the control signal.

19. The controller unit of claim 12, wherein the control routine implements a multiple-input/multiple-output control routine to generate the control signal.

20. The controller unit of claim 12, wherein the control routine implements a multiple-input/single-output control routine to generate the control signal.

21. A steam generating boiler system, comprising:

a boiler having a furnace, a superheater section and a reheater section coupled to the superheater section; and a controller communicatively coupled to the boiler to control operation of the boiler, the controller being communicatively connected to the reheater section to receive a signal, the signal being indicative of a desired value of at least one of a reheater steam temperature control variable or a reheater steam temperature manipulated variable, and the signal being not indicative of a superheater spray setpoint and the controller including:

a first routine that uses the signal indicative of the desired value of the at least one of the reheater steam temperature control variable or the reheater steam temperature manipulated variable to produce a first signal, and a second routine that uses the first signal and a second signal indicative of a firing rate to generate a control signal to be used to control:

a fuel to feedwater ratio of the furnace and a boiler of the steam generating boiler system, a fuel/air mixture provided to the furnace, or an amount, a quantity or a type of fuel, thereby controlling a steam temperature generated by the superheater section.

22. The steam generating boiler system of claim 21, wherein the boiler includes one or more dampers for directing flow of gas through the superheater section and the reheater section and wherein the signal indicative of the desired value of the at least one of the reheater steam temperature control variable or the reheater steam temperature manipulated variable is indicative of a desired position of the one or more dampers.

23. The steam generating boiler system of claim 21, wherein the furnace includes one or more tiltable burners for effecting a temperature of gas in the superheater section and the reheater section and the desired value of the at least one of the reheater steam temperature control variable or the reheater steam temperature manipulated variable is indicative of a desired tilt position of the one or more tiltable burners.

24. The steam generating boiler system of claim 21, wherein the boiler is a once-through boiler.

25. The steam generating boiler system of claim 21, further including a reheater spray unit for controlling steam temperature at an output of the reheater section and wherein the controller includes a further control routine for controlling an operation of the reheater spray unit.

26. The steam generating boiler system of claim 25, further including a superheater spray unit for controlling steam temperature at an output of the superheater section and wherein the controller includes a further control routine for controlling an operation of the superheater spray unit.

27. The steam generating boiler system of claim 21, further including a superheater spray unit for controlling steam temperature at an output of the superheater section and wherein the controller includes a further control routine for controlling an operation of the superheater spray unit.

28. The steam generating boiler system of claim 21, wherein the control routine is a proportional-integral-derivative control routine.

29. The steam generating boiler system of claim 21, wherein the control routine is a multiple-input/multiple-output control routine.

30. The steam generating boiler system of claim 21, wherein the control routine is a multiple-input/single-output control routine.

31. A once-through boiler system, comprising:

a furnace;

a superheater section;

a first turbine coupled to the output of the superheater section;

a reheater section coupled to the first turbine;

a second turbine coupled to the output of the reheater section; and a controller to control operation of the furnace, the controller being communicatively connected to the reheater section to receive a first signal, the first signal being indicative of a desired value of one of a reheater steam temperature control variable or a reheater steam temperature manipulated variable, and the first signal being not indicative of a superheater spray setpoint and the controller including:

a first routine that uses the first signal and a second signal indicative of an actual value of the one of the reheater steam temperature control variable or the reheater steam temperature manipulated variable indicative of the reheater steam temperature control or manipulated variable to produce a third signal; and a second routine that uses the third signal and a signal indicative of a firing rate to produce a control signal, the control signal to be used to control:

a fuel to feedwater ratio of the furnace and a boiler of the steam generating boiler system, a fuel/air mixture provided to the furnace, or an amount, a quantity or a type of fuel, thereby controlling a steam temperature at the output of the superheater section.

32. The once-through boiler system of claim 31, further including one or more dampers for directing flow of gas through the superheater section and the reheater section and wherein one of the reheater steam temperature control variable or the reheater steam temperature manipulated variable is indicative of a position of the one or more dampers.

33. The once-through boiler system of claim 31, wherein the furnace includes one or more tiltable burners for effecting the temperature of gas in the superheater section and the reheater section and wherein the one of the reheater steam temperature control variable or the reheater steam temperature manipulated variable is indicative of a tilt position of the one or more tiltable burners.

34. The method of controlling a steam generating boiler system of claim 1:

wherein the first signal is indicative of the desired value of the reheater manipulated variable;

the method further comprises obtaining, at the controller, a fifth signal indicative of the reheater control variable used in the reheater section; and wherein using the first signal in conjunction with the second signal to generate the third signal comprises using the first signal and the fifth signal in conjunction with the second signal to generate the third signal.

35. A controller unit of claim 12, wherein the signal indicative of the actual value of the at least one of the reheater steam temperature control variable or the reheater steam temperature manipulated variable is a signal indicative of the actual value of the reheater steam temperature manipulated variable, and the controller unit further comprises:

a third input to receive a signal indicative of the actual value of the reheater steam temperature control variable used in steam temperature control of the reheater section; and a fourth input to receive a setpoint associated with the reheater steam temperature control variable, wherein the control routine uses the signal indicative of the actual value of the reheater steam temperature control variable, the setpoint associated with the reheater steam temperature control variable, the signal indicative of the actual value of the reheater steam temperature manipulated variable, and the setpoint associated with the reheater steam temperature manipulated variable to develop the control signal.

36. The steam generating boiler system of claim 21, wherein:

the signal indicative of the desired value of the at least one of the reheater steam temperature control variable or the reheater steam temperature manipulated variable is a signal indicative of the desired value of the reheater steam temperature manipulated variable, the controller is communicatively connected to the reheater section to further receive a signal indicative of the desired value of the reheater steam temperature control variable, and the routine included in the controller uses the signal indicative of the desired value of the reheater steam temperature control variable and the signal indicative of the desired value of the reheater steam temperature manipulated variable to produce the first signal.

37. The once-through boiler system of claim 31, wherein:

the first signal is indicative of the desired value of the reheater steam temperature manipulated variable, the controller is communicatively connected to the reheater section to further receive a fourth signal indicative of the desired value of the reheater steam temperature control variable, and the routine included in the controller uses the first signal, the second signal, indicative of the reheater steam temperature control variable and the fourth signal indicative of the reheater steam temperature manipulated variable to produce the third signal to be used to control the fuel to feedwater ratio, the fuel/air mixture, or the amount, the quantity or the type of fuel.

* * * * *

UNITED STATES PATENT AND TRADEMARK OFFICE

CERTIFICATE OF CORRECTION

PATENT NO. : 8,104,283 B2
APPLICATION NO. : 11/759805
DATED : January 31, 2012
INVENTOR(S) : Xu Cheng et al.

It is certified that error appears in the above-identified patent and that said Letters Patent is hereby corrected as shown below:

In the Specification:

At Column 2, line 2, "causes" should be -- cause --.

At Column 3, line 16, "the these" should be -- these --.

At Column 6, line 57, "tact" should be -- fact --.

In the Claims:

At Column 10, line 34, "quanity" should be -- quantity --.

At Column 10, line 49, "conjuction" should be -- conjunction --.

At Column 13, lines 46-48, "variable indicative of the reheater steam temperature control or manipulated variable to" should be -- variable to --.

Signed and Sealed this
Ninth Day of July, 2013

Teresa Stanek Rea
*Acting Director of the United States Patent and Trademark Office*